US005887300A

United States Patent [19]

Pond

[11] Patent Number: 5,887,300

[45] Date of Patent: Mar. 30, 1999

[54] MAT COVER WITH SELF ENCASED PILLOW

[76] Inventor: Emma Pond, 17519 Rustling Aspen La., Houston, Tex. 77095

[21] Appl. No.: 926,361

[22] Filed: Sep. 9, 1997

[51] Int. Cl.[6] ..... A47G 9/06; A47G 9/00

[52] U.S. Cl. ..... 5/420; 5/490

[58] Field of Search ..... 5/417–420, 490, 5/737

[56] References Cited

U.S. PATENT DOCUMENTS

| | | | |
|---|---|---|---|
| 1,925,358 | 9/1933 | Wittcoff | 5/419 |
| 2,498,055 | 2/1950 | Veit | 5/497 |
| 4,967,428 | 11/1990 | Browder | 5/419 |
| 5,099,530 | 3/1992 | Scott | 5/420 |
| 5,199,120 | 4/1993 | Holmes | 5/419 |
| 5,457,829 | 10/1995 | Elliott | 5/420 |

FOREIGN PATENT DOCUMENTS

| | | | |
|---|---|---|---|
| 2444435 | 8/1980 | France | 5/419 |
| 2446622 | 9/1980 | France | 5/419 |

*Primary Examiner*—Alex Grosz

[57] ABSTRACT

A mat cover is constructed of an upper and lower panel having a mat therebetween, and a pillow containing pouch overlaying the upper panel, with the pillow containing pouch defined by a folded flap attached to the top edge and side portions of the lower panel.

2 Claims, 3 Drawing Sheets

MAT COVER WITH SELF ENCASED PILLOW

BACKGROUND

1. Field of the Invention

A mat cover with self encased pillow relates to a textile product cover for a mat, and more particularly to the improved design of a self encased pillow incorporated into the cover.

2. Description of Prior Art

Children attending day care or preschool are often required to have a nap or rest period during their day. Individuals often purchase a mat capable of being compactly folded and conventionally made of foam rubber covered with flexible plastic. While a mat may be wiped for sanitation purposes, simple wiping does not substitute for laundering with appropriate detergent. An uncovered exposed mat is also uncomfortable, often causing the user's skin to perspire and cling to the plastic covering. There are several patents that disclose various rest mats.

The cover for exercise mat in U.S. Pat. No. 5,099,530 to Scott (1992) contains an external pocket sewn onto the top layer with such pocket not fastened in the closed position, allowing the pillow to be easily withdrawn resulting in a possibility of losing the pillow.

The child's resting mat organization in U.S. Pat. No. 4,967,428 to Browder (1990) contains a pillow that is attached to the cover by hoop and loop fastener strips which could become detached and lost.

The portable combined lounging mat and pillow having a pocket in U.S. Pat. No. 5,199,120 to Holmes (1993) combines a mat and pillow produced from a single large piece of suitable fabric. While the risk of losing the attached pillow is reduced, there are drawbacks to this combination: (a) sanitation is compromised as materials frequently used for filling a pillow and for constructing a lounging mat generally do not dry during laundering at the same rate resulting in a damp pillow; and (b) inefficiency is increased as the attached pillow is generally unsalvageable if a lounging mat is damaged or overly soiled.

OBJECTS AND ADVANTAGES

Accordingly, the object and advantage of a mat cover with self encased pillow is a textile product mat cover with an improved design of a self encased pillow incorporated into the cover. Unlike prior patents, an inverted self encased pouch is ample to hold a pillow securely during use and transport while making removal of a pillow difficult, particularly to a child. Many day care and preschool facilities have storage limitations requiring individuals to carry their mats to and from the facility daily. A mat with mat cover and self encased pillow in place may be folded as a single unit for convenience in transport and storage, lessening the chances of losing the pillow. A pillow in a mat cover with self encased pillow is totally encased and not directly exposed during use, transport and storage making sanitation a significant factor. By removing the mat and pillow, the cover with self incorporated pillow case may be laundered as one item.

Further objects and advantages of a mat cover with self encased pillow will become apparent from a consideration of the drawings and ensuing description.

SUMMARY OF THE INVENTION

The object of a mat cover with self encased pillow is to provide a comfortable, sanitary and convenient resting apparatus. The cover's unique self encased pillow design holds a pillow securely in the cover and does not require the utilization notions, including but not limited to, hooks or snaps or scratchy hook and loop fasteners, to achieve desired results. The construction technique of the cover serves multiple purposes: (a) for comfort by keeping a removable mat from sliding out of the cover; (b) for sanitation, by allowing the removal of a mat and pillow from the cover for laundering or disposal; and (c) for convenience, by permitting the mat, cover and pillow to be used, transported and stored as a single unit.

DETAILED DESCRIPTION

Figure 1:
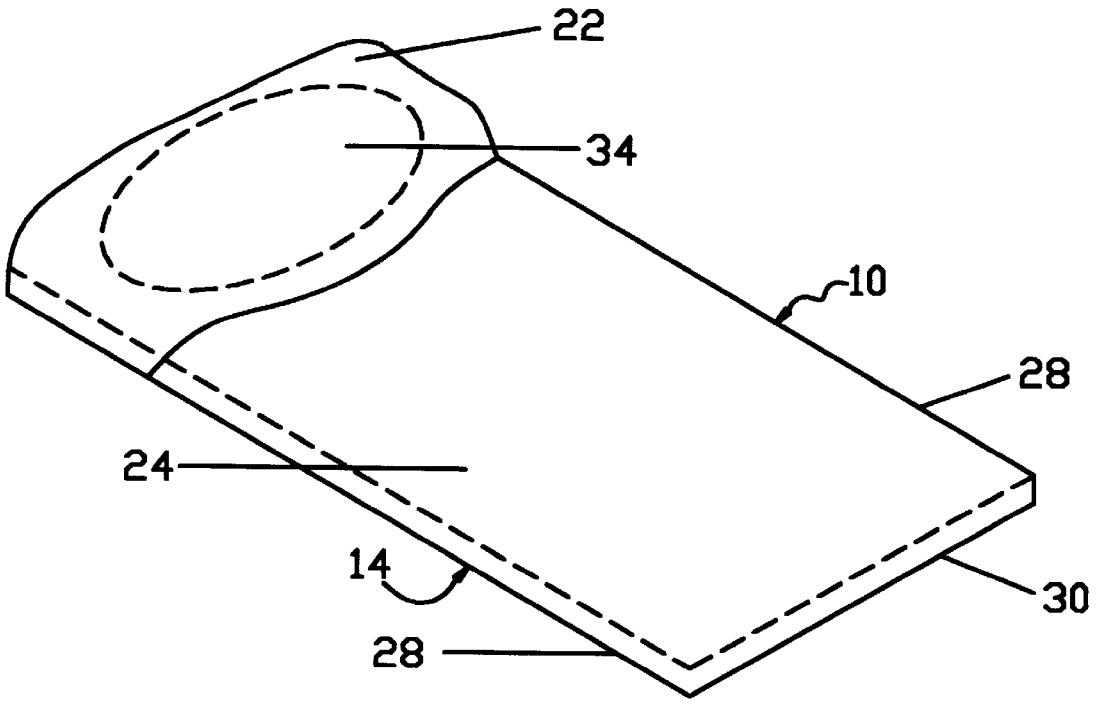
FIG. 1 is an illustration of a mat cover with a self encased pillow in an end use perspective.
Figure 2A:
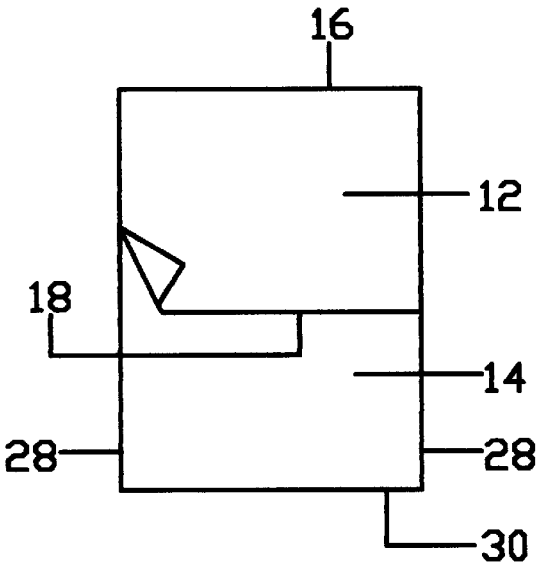
FIG. 2A illustration of a method of attaching a flap to an under panel.

Referring to numerical references in the drawings, in FIG. 1, a cover (10) is constructed of a textile product. The cover (10), having a head portion (32) and a foot portion (30) is adapted to releasably retain a pillow (34) in a pillow pouch (22) and a flexible mat core (M) in a pouch defined between an upper panel (24) and an under panel (14). The cover (10), shown in its assembled form in FIG. 1, is assembled by following steps, shown in FIGS. 2A,2B, 2C and 3. Initially a flap (12) is positioned on under panel (14), as seen in FIG. 2A, and the flap (12) is secured to the under panel (14) at their uppermost or top edges (16). Subsequently the lower or bottom edge (18) of flap (12) is folded upwardly along marking line (20) to position the lower edge (18) of flap (12) adjacent the top of the under panel (14) to define uppermost edges (16), as best seen in FIG. 2B.

Figure 2B:
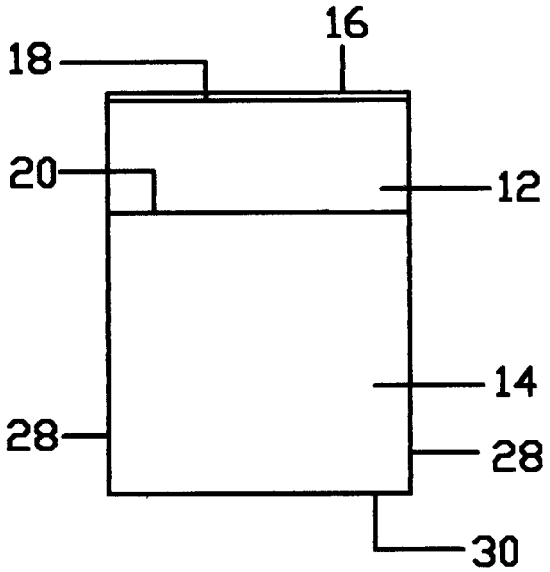
FIG. 2B is an illustration of a method of folding a lower edge of a flap upward to form a pillow pouch.
Figure 2C:
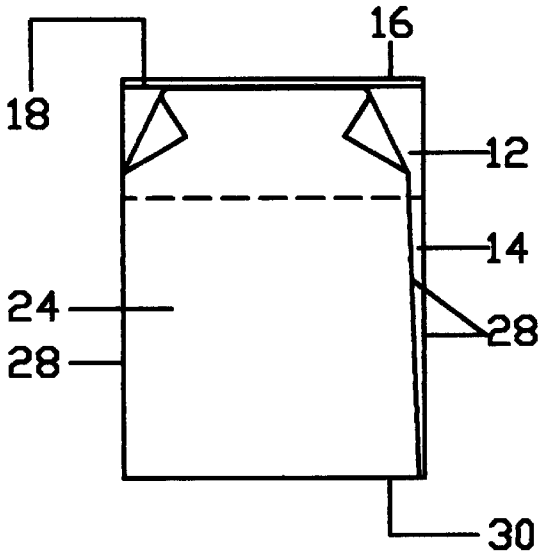
FIG. 2C is an illustration of a method of assembling a cover with an incorporated pillow pouch by securing the upper panel to the under panel.
Figure 2D:
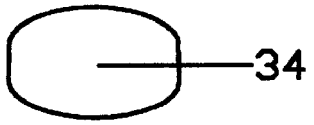
FIG. 2D is an illustration of a pillow.

The left and right edges of the now folded flap (12) are secured to the under panel (14) to thereby form a pillow retaining pouch (22) having an open edge defined by uppermost edges (16) as seen in FIG. 2B. An upper panel (24) having the same size and shape as under panel (14) is secured, by seams, along side edges or borders (28) and foot portion (30) to the under panel (14), leaving an opening at the top, as best seen in FIG. 2C, to thereby define a pouch.

Figure 3:
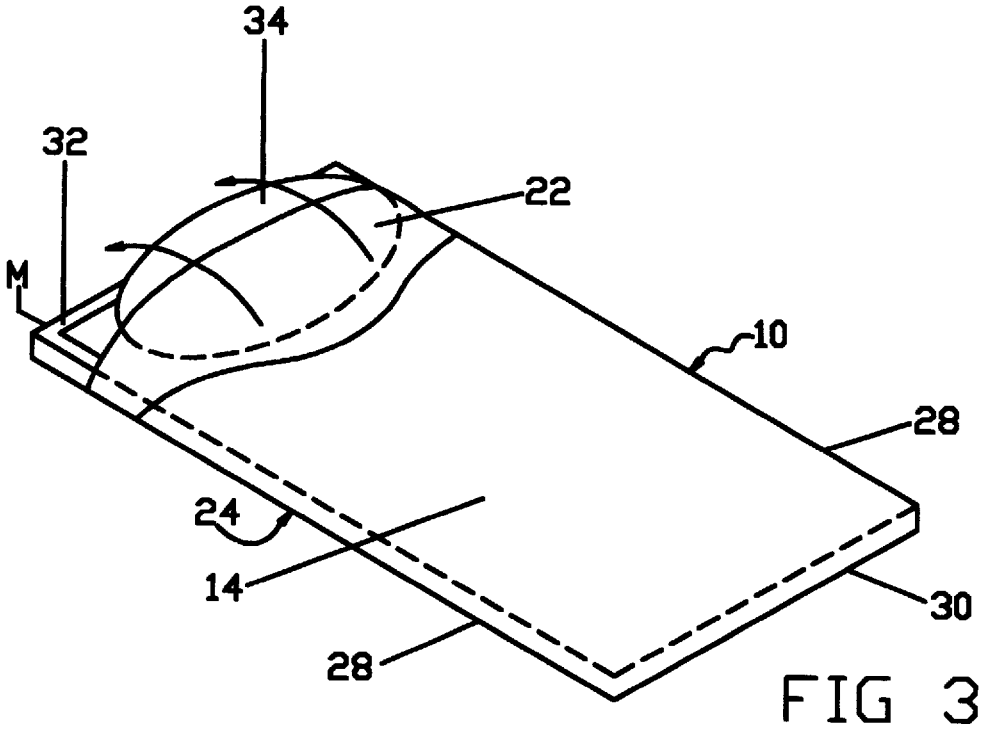
FIG. 3 is an illustration of a cover's underside displaying a removable mat and pillow in the inserted position with method of creating a self encased pillow.
Figure 4:
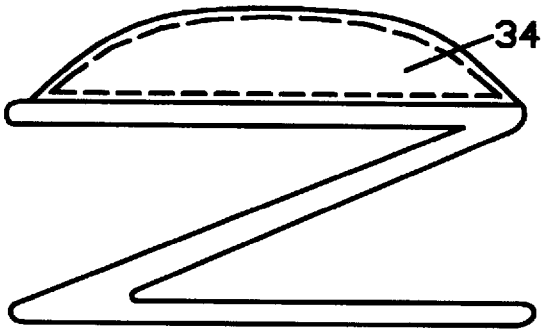
FIG. 4 is an illustration of a side elevation of a folded mat cover with self encased pillow.

The above obtained pouch is inverted or turned inside out so that the seams are on the inside of the pouch. The inverted pouch has an opening, near the head portion (34) through which a flexible mat core (M) is inserted, which mat core (M) is best seen in FIG. 3. A pillow (34) is inserted in the pillow pouch (22). The pillow pouch (22) is inverted or turned inside out, as shown by arrows in FIG. 3, to position the opening of the pillow pouch (22) adjacent the opening of the mat core containing pouch, to thereby securely and removably retain the pillow (34) and the mat core (M) within the cover (10) without the use of separable fasteners such as hooks or snaps, or hook and loop fasteners.

As seen in FIG. 1, the pillow pouch overlays the upper panel (24) and has an opening adjacent the top edge of the lower panel, extending between the side edges of the lower panel.

Reference Numerals in Drawings

| Part Number | Part Name |
|---|---|
| 10 | Cover |
| 12 | Flap |
| 14 | Under panel |
| 16 | Uppermost edges |
| 18 | Lower edge |
| 20 | Marking line |
| 22 | Pillow pouch |
| 24 | Upper panel |
| 28 | Opposing side borders |
| 30 | Foot portion |
| 32 | Head portion |
| 34 | Pillow |

Conclusion, Ramifications and Scope of Invention

Accordingly, the reader will see that a mat cover with self encased pillow provides a comfortable, sanitary and convenient resting apparatus.

While a mat cover with self encased pillow has been described fully and completely with special emphasis upon a preferred embodiment, and since numerous modifications and changes may readily occur to those skilled in the art, it is not desired to limit the invention to the exact construction shown and described. For example, a flexible mat core material may be contained in a mat cover with self encased pillow by permanently securing the upper panel to the under panel along opposing side borders, foot portion and head portion. The dimensions of a cover with self encased pillow matches the shape of a mat whether it is rectangular or square. A mat cover with self encased pillow may be used without the pillow inserted. Accordingly, all suitable modifications and equivalents may be determined by falling within the scope of the invention.

What is claimed is:

1. A flexible, foldable article, for supporting the body of a reclining user, having a head portion and a foot portion, comprising:

(a) an upper panel and a lower panel, each having a top edge, and a bottom and side edges secured to each other, and defining a pouch adapted to contain a flexible mat core;

(b) a pillow retaining pouch, adapted to removably retain a pillow, the pouch overlaying the upper panel and defined by a folded flap secured to the top edge and upper side portions of the lower panel and having an opening adjacent the top edge of the lower panel, extending between the side edges of the lower panel.

2. The article of claim 1, wherein the top edges of the upper and lower panel are secured to each other, whereby a flexible mat core is not removable from the pouch defined between the upper and lower panels.

* * * * *